United States Patent [19]

DeGroot et al.

[11] Patent Number: 4,850,284

[45] Date of Patent: Jul. 25, 1989

[54] PALLET AND METHOD OF FORMING AND SECURING PALLET LEGS

[75] Inventors: Robert H. DeGroot, River Forest; Robert Kropidoski, North Riverside; Frank Wakaszek, Bridgeview; Jesus Rivera, Jr., Berwyn, all of Ill.

[73] Assignee: Packing Materials Corporation, Chicago, Ill.

[21] Appl. No.: 825,673

[22] Filed: Feb. 3, 1986

Related U.S. Application Data

[63] Continuation of Ser. No. 634,456, Jul. 26, 1984, abandoned.

[51] Int. Cl.[4] ..... B65D 19/34

[52] U.S. Cl. ..... 108/56.3; 108/51.3

[58] Field of Search ..... 108/56.3, 51.3

[56] References Cited

U.S. PATENT DOCUMENTS

| | | | |
|---|---|---|---|
| 2,493,562 | 1/1950 | Yarman | 108/51.3 |
| 2,507,588 | 5/1950 | Brandon et al. | 108/51.3 |
| 2,631,724 | 3/1953 | Wright | 108/51.3 X |
| 2,888,221 | 5/1959 | Connelly | 108/51.3 |
| 3,407,758 | 10/1968 | Simkins | 108/56.3 X |
| 4,015,544 | 4/1977 | Szatkowski | 108/51.3 |
| 4,487,136 | 12/1984 | Beckway | 108/51.3 |

FOREIGN PATENT DOCUMENTS

| | | | |
|---|---|---|---|
| 268989 | 2/1969 | Austria | 108/51.3 |

*Primary Examiner*—Peter R. Brown

*Attorney, Agent, or Firm*—Robert E. Knechtel; Basil E. Demeur

[57] ABSTRACT

A pallet having a pallet deck which is formed from at least two pallet deck members, each of which has finger elements die-cut therein at each leg attachment point. The pallet legs are formed from tubular outer and inner leg elements, and are attached to both pallet deck members by stacking them atop one another and forcibly urging the finger elements on both pallet deck members within the annulus between the nested outer and inner leg elements. With this construction, the pallet deck is increased in strength since two pallet deck members are utilized and the pallet legs have greater strength and are less subject to damage from sideways forces parallel to the pallet applied to them since they are attached to the pallet by the finger elements die-cut in both of the pallet deck members.

10 Claims, 3 Drawing Sheets

FIG. 1
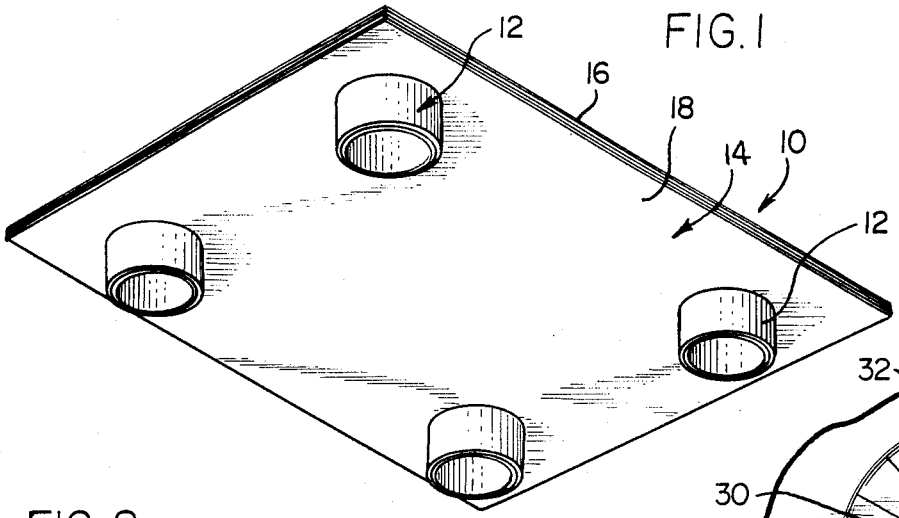
FIG. 4
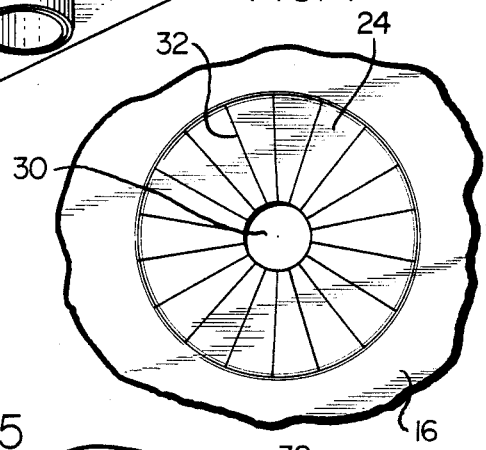
FIG. 2
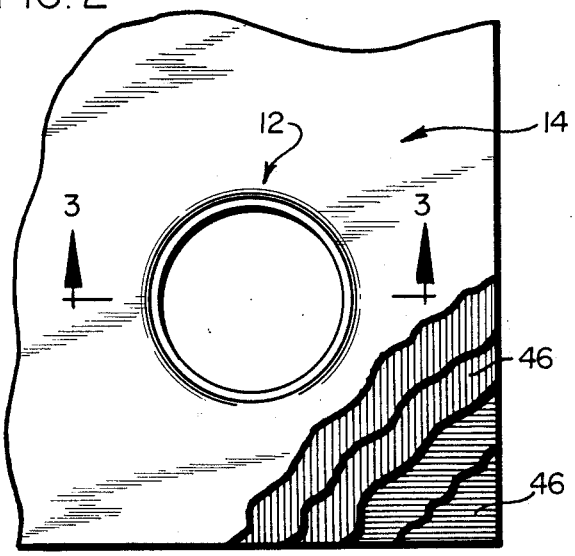
FIG. 5
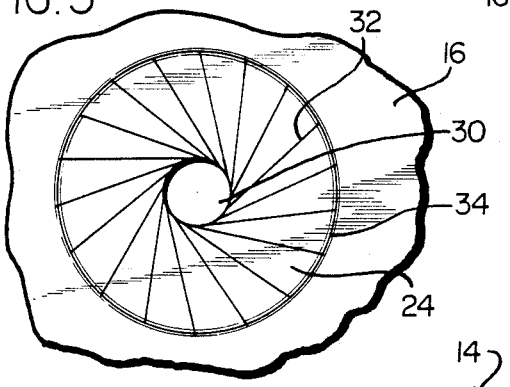
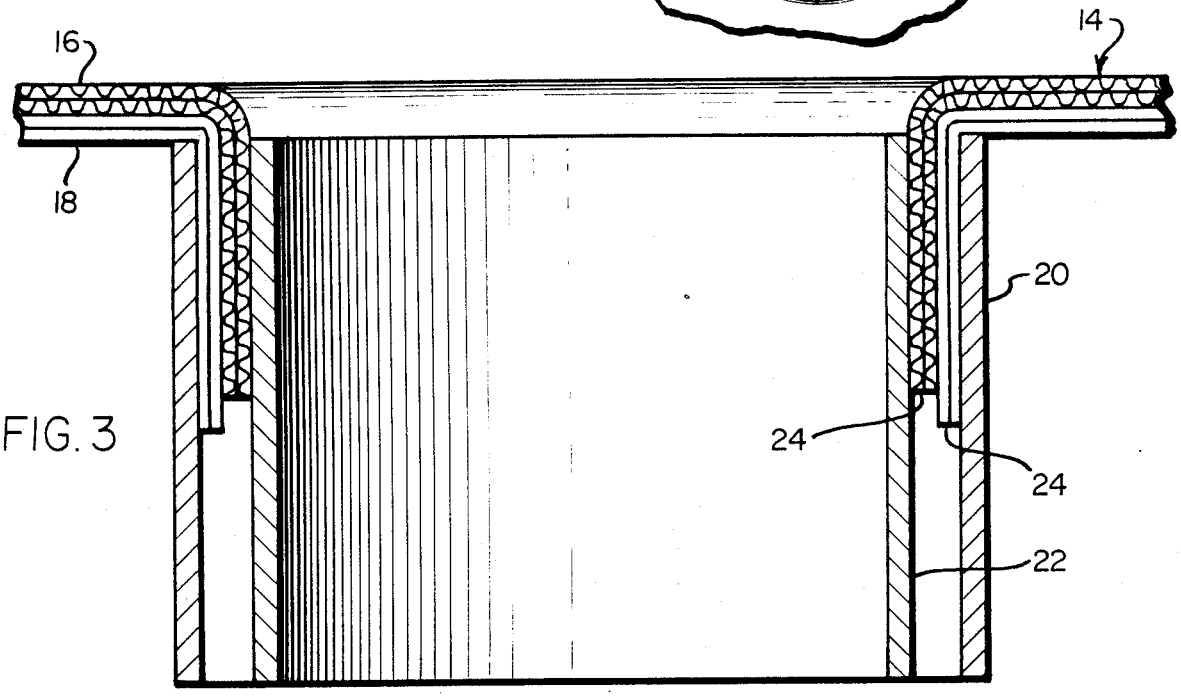
FIG. 3

FIG. 12
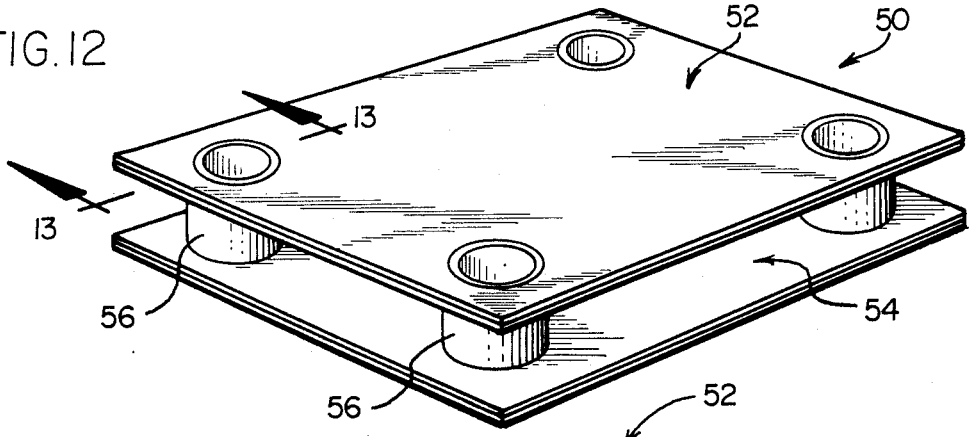
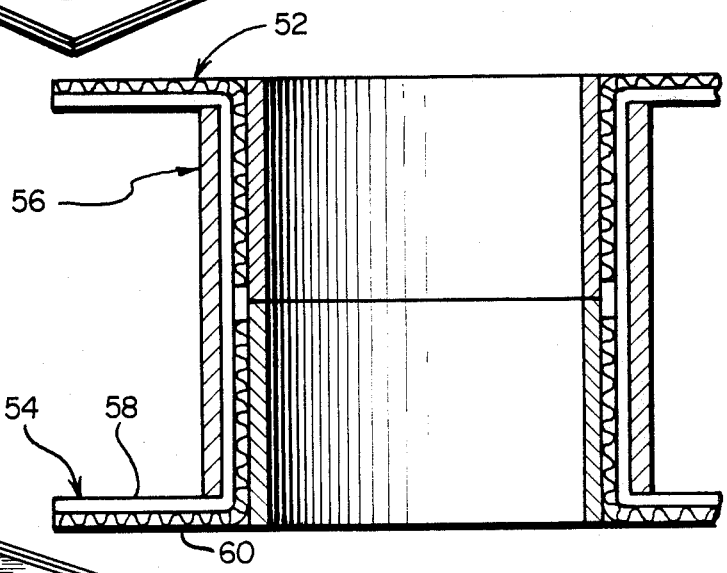
FIG. 13
FIG. 14
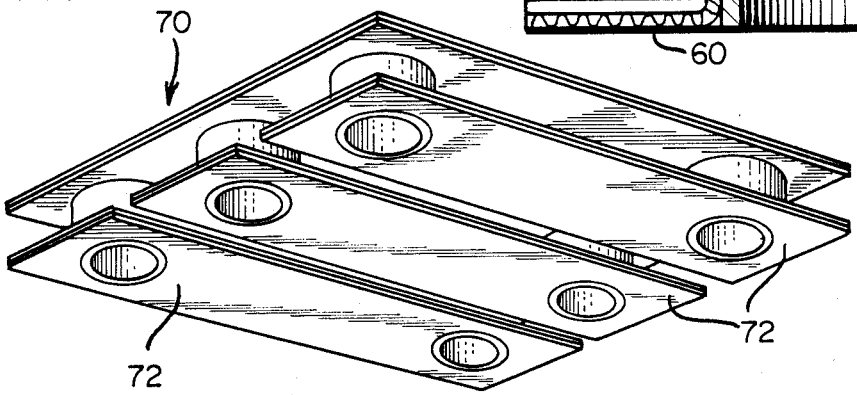
FIG. 15
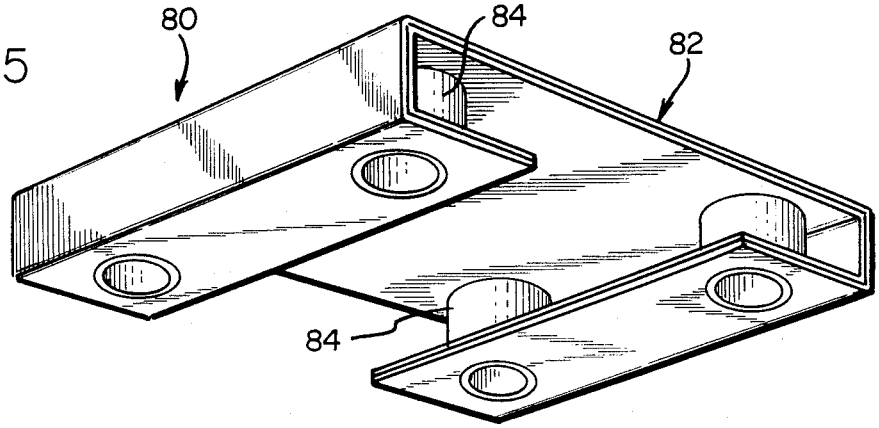

PALLET AND METHOD OF FORMING AND SECURING PALLET LEGS

This is a continuation of co-pending application, Ser. No. 634,456, filed July 26, 1984, now abandoned.

BACKGROUND OF THE INVENTION

This invention relates to pallets, and in particular to inexpensive and lightweight pallets.

The pallets of the present invention preferably are constructed of corrugated cardboard, however, it will be appreciated that they may be constructed of other similar types of materials such as solid fibreboard or pasted chipboard.

Prior art pallets have employed flat corrugated pallet decks to which a plurality of leg members are attached. The pallet deck is supported above its resting surface so that the pallet and its contents may be picked up by mechanized equipment such as a forklift truck.

Prior art corrugated pallets have utilized a simple and effective attachment means by which a tubular cardboard leg, usually constructed of spiral laminated paperboard material, is attached to the pallet deck by gluing. To effect a strong attachment, the prior art corrugated pallets have utilized a sunburst-shaped pattern which is die-cut in the corrugated pallet deck at each leg attachment point. The die-cut pattern utilizes a central hole with radiating die cuts terminating at an outer radius corresponding to the inner diameter of the pallet leg. The finger members thus formed are generally referred to as straight finger members and have blunt tips where they originate from the central hole.

After cutting, the straight finger members are forced downward into an annulus between two nested tubular leg elements. Glue is applied to the finger elements prior to being forced downward into the annulus to fixedly secure the finger elements within the annulus, and hence the pallet leg to the pallet deck. Pallets having pallet legs attached thereto in the manner described are disclosed in U.S. Pat. Nos. 2,665,807; 3,052,397; 3,266,444 and French Pat. No. 1,470,774.

An improvement of the above-described pallet and method of attaching pallet legs thereto is disclosed in U.S. patent application Ser. No. 453,760, filed Dec. 27, 1982. As disclosed therein, the finger elements are formed by die-cut lines tangent to a central hole so that a somewhat spiral pattern is formed, much like a camera iris. The resulting finger members are generally referred to as spiral finger elements, as opposed to the straight finger elements. These spiral finger elements, according to various test results, provide a pallet leg which is far stronger and less subject to damage when a sideways force parallel to the pallet deck member is applied to the pallet leg.

The pallets disclosed in the above-identified U.S. patents and the referenced patent application, in many cases, have another corrugated cardboard pallet deck member adhesively affixed atop the pallet deck to which the pallet legs are affixed in order to provide additional strength to the pallet. The pallet per se is strengthened in this fashion, but the added pallet deck member does not strengthen to any substantial degree the pallet leg against damage from sideway forces applied to them.

While the pallets of the above-identified type are generally satisfactory, there is still a desire for an inexpensive and lightweight pallet of corrugated cardboard which has both greater deck strength and pallet legs which are not as susceptible to damage when a sideways force is applied to them. The deck strength can be increased by adhesively affixing another pallet deck member atop the pallet deck as described above, but this method of increasing the deck strength suffers from the expense and difficulties associated with adhesively affixing the other pallet deck member to the pallet. For example, adhesive must be applied to one or surfaces of the two pallet deck members, the two deck members properly aligned atop one another, and then clamped until the adhesive sets. These requirements all add to the cost of the pallets.

Also, for the purpose of storing and shipping these standard pallets, the pallets normally are stacked atop one another to a height of 84". The four corners of the stacked pallets are protected with creased corrugated cardboard dimensioned to extend the 84" height of the stack and 6 inches on each side of the stack about the corners. The stacked pallets then are stretch wrapped or banded. The need to provide the corner protectors likewise adds to the cost of the pallets.

Accordingly, it is an object of the present invention to overcome the above as well as other disadvantages of these prior art pallet designs, and to provide an improved inexpensive and lightweight pallet having both a greater deck strength and pallet legs having greater strength against sideways force applied to them.

Further still, it is an object to provide such an improved pallet which is far simpler to manufacture.

A still further object is to provide such an improved pallet which is far simpler and less expensive to stack for storage and shipment.

The above as well as other objects not specifically mentioned are accomplished by providing a pallet having a pallet deck which is formed from at least two pallet deck members, each of which has finger elements die-cut therein at each leg attachment point. The pallet deck members may be of solid fibreboard, pasted chipboard and other like materials, however, it is preferred to use corrugated cardboard since this material is lightweight and the most expensive. The pallet legs are formed from tubular outer and inner leg elements, and are attached to both pallet deck members by stacking them atop one another and forcibly urging the finger elements on both pallet deck members within the annulus between the nested outer and inner leg elements. With this construction, the pallet deck is increased in strength since two pallet deck members are utilized and the pallet legs have greater strength and are less subject to damage from sideways forces parallel to the pallet applied to them since they are attached to the pallet by the finger elements die-cut in both of the pallet deck members.

Pallets constructed in this fashion also are far easier to assemble. The finger elements are die-cut into each of the pallet deck members by the same die, and therefore are in perfect alignment when the two deck members are stacked atop one another. Also, it is not necessary to adhesively affix the two deck members to one another, since the tubular leg elements effectively function like rivets to secure the deck members together. Preferably, however, some adhesive is applied to the mating surfaces of the deck members. Even though some adhesive is used, a substantial advantage is still provided, since the tubular leg elements function to secure the deck members together until the adhesive sets, thus the need to clamp them together as in the past is eliminated.

A multiple number of pallet deck members can be stacked atop one another to form the pallet deck and when corrugated cardboard is used each pallet deck member can be single wall, double wall or thicker corrugated cardboard or any combination thereof. However, in a preferred embodiment, only two pallet deck members are used, and each of them is a double wall corrugated cardboard. The double wall deck members are die-cut and assembled as described above, and provide a pallet which is both economical and sufficiently strong for most applications. The inner leg elements preferably are of a length to substantially cover the finger elements when assembled to form the pallet legs. The pallet legs can be reinforced for both load capacity and abrasive wear by using an inner leg element which is of substantially the same height, or length, as the outer leg element. A pallet leg of this construction also can be used on a standard pallet which has a pallet deck formed on one single wall corrugated cardboard deck member, but the single wall corrugated deck member does not have sufficient strength and the pallet leg under extremely rough use can be torn off. Accordingly, there is little benefit in reinforcing the pallet legs on a standard pallet in this fashion, if the pallet is to be subjected to extremely rough use.

In accordance with the invention, it is also preferred to cross laminate the corrugated cardboard deck members, i.e., the corrugations of the deck members extend perpendicular to each other. Such cross laminating of the deck members substantially increases the deck strength of the pallet. Further still, according to the invention, a substantial improvement in the strength of the pallet legs is provided whether straight or spiral finger elements are used, when the finger elements die-cut in both pallet deck members are captured between the nested outer and inner legs elements. Again, however, it is preferred to use spiral finger elements, since they provide several advantages not provided by the straight finger elements. In particular, the spiral finger elements are much stronger and therefore provide a pallet leg which is much stronger and more resistant to sideways forces applied to them. In addition, the spiral fingers are longer in length than the straight fingers. Accordingly, when the multiple corrugated cardboard deck members are used, the spiral finger elements when forced downwardly into the annulus between the two nested outer and inner leg elements forming the pallet legs provide a longer and hence more finger surface area which is affixed together to one another and to the walls of the leg elements.

Also, according to the invention, it is preferred that the spiral finger elements on each of the pallet deck members substantially fully overlap each other. Also, the score lines defining the outer periphery of the finger elements should project downwardly on both pallet deck members when stacked atop one another. In order to achieve this arrangement, one pallet deck member is run through the die-cutting machine with its corrugations running in one direction and the other pallet deck member is run through with its corrugations running perpendicular to the first deck member. Effectively, a top and a bottom pallet deck member are die cut, but it makes no difference which is the top, or the bottom, deck member. When die-cut in this fashion and stacked atop one another with a cross lamination, the finger elements when forced downwardly into the annulus between the nested outer and inner leg elements will substantially fully overlap each other. The overlapped spiral finger elements provide pallet legs which have far greater strength, particularly against sideways forces applied against them.

It is also possible to die-cut the pallet deck members as described above, and to then flip over one pallet deck member and stack it atop the other. In this instance, however, when the finger elements are forced downwardly into the annulus between the outer and inner leg elements, the spiral finger elements of one deck member project radially in one direction and those on the other deck member project radially in the opposite direction so that there is a radial overlapping of the finger elements. While assembling the pallet deck members in this fashion provides an increase in the strength of the pallet legs, the increase is not as great as it is when the finger elements substantially fully overlap each other.

Pallets constructed in accordance with the present invention provide still another advantage over the standard pallets when stacking the pallets for storage or shipment. As indicated above, the pallets normally are stacked atop one another to a height of 84" and prior to handling or stretch wrapping the stacked pallets, the four corners of the stacked pallets are protected with corrugated cardboard corner protectors. Since the deck members of the pallets of the present invention are much stronger than the standard pallets, it is found that the normally used corrugated cardboard corner protectors can be eliminated. Also, the pallets can be secured in the stacked relationship simply by banding them together by extending a band through the holes of the pallet legs. In each instance, a substantial cost savings is provided.

A lightweight and inexpensive pallet having exceptional beam strength for supporting and transporting heavy loads, by means of forklift trucks and automated mechanical load handling conveying or transporting equipment, can be provided by adding a second pallet deck to the underside of the pallet. More specifically, according to the invention, a second pallet deck is secured to the pallet by attaching the second pallet deck to the bottom of the pallet legs in the same fashion as the pallet deck is attached to the top of the pallet legs. The pallet legs thus are effectively sandwiched between the two pallet decks. With this construction, a rigid pallet having a substantially greater beam strength, i.e., less tendency to flex in the longitudinal plane thereof, is provided. The beam strength also can be increased by affixing parallel strips, as opposed to a fully pallet deck, to the pallet legs. Further still, the beam strength can be increased by extending one length of the pallet deck such that the pallet deck can be folded essentially U-shaped along two opposing edges thereof and affixed to the pallet legs.

Other objects and advantages of the invention will become apparent from the following detailed description and upon reference to the drawings.

BRIEF DESCRIPTION OF THE DRAWINGS

FIG. 1 is a perspective view of a pallet exemplary of the invention;

FIG. 2 is a partial bottom plan view of the pallet of FIG. 1, partially sectionalized to illustrate the cross lamination of the pallet deck members;

FIG. 3 is an enlarged sectional view taken along lines 3—3 of FIG. 2;

FIG. 4 is a partial top plan view of one of the pallet deck members illustrating the straight finger elements die cut therein at a leg attachment point;

FIG. 5 is a view like FIG. 4 only illustrating the spiral fingers due cut in a pallet deck member at a leg attachment point;

FIG. 12 is a perspective view of a pallet having a second pallet deck affixed to it to provide improved beam strength;

FIG. 13 is a sectional view taken along lines 13—13 of FIG. 12, and

FIG. 14 and 15 are side plan views of pallets illustrating alternative methods of improving beam strength.

DESCRIPTION OF THE PREFERRED EMBODIMENT

Figure 6:
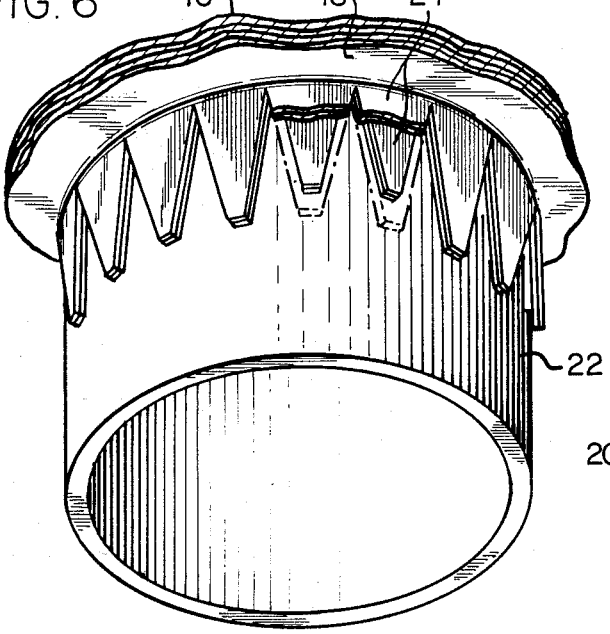
FIG. 6 is a partial perspective view, with the outer leg element removed, illustrating the manner in which the straight finger elements overlap when disposed within the annulus between the outer and inner leg elements.

Referring now to the drawings, in FIG. 1 there is illustrated a pallet 10 having four pallet legs 12 affixed thereto to the underside thereof. While only four pallet legs 12 are shown, it is apparent that any number of pallet legs can be affixed to the pallet. The pallet 10 includes a pallet deck 14 which is constructed of multiple (two as illustrated) pallet deck members 16 and 18 which are of the same dimensions and are stacked atop one another, as more specifically described below. As indicated above, the pallet deck members 16 and 18 may be of solid fibreboard, pasted chipboard and other like materials, but preferably they are of a corrugated cardboard material. The pallet legs 12 each is formed of an outer leg element 20 which is dimensioned to receive therein an inner leg element 22, with the finger elements 24 which are die-cut in the respective ones of the pallet deck members 16 and 18 at the leg attachment points compressed and retained within the annulus 28 between the nested outer and inner leg elements 20 and 22, as illustrated in FIG. 3. The outer and inner leg elements 20, 22 may be laminated paper tubular elements.

The finger elements 24 die-cut in the respective ones of the pallet deck members 16 and 18 may be straight finger elements as illustrated in FIG. 4, or spiral finger elements, as illustrated in FIG. 5. More specifically, the straight finger elements of FIG. 4 are die-cut in a sunburst-shaped pattern and utilize a central hole 30 with radiating die cuts 32 terminating at an outer radius or score line 34 having a diameter corresponding to the inner diameter of the pallet leg 12. The finger elements 24 thus formed have blunt tips where they originate from the central hole 30. The spiral finger elements of FIG. 5 are formed in substantially the same fashion, however, the die-cuts 32 radiate outwardly tangentially from the central hole 30 so as to provide a spiral or iris-like pattern. In forming the pallet 10 either straight finger elements or spiral finger elements can be used. In either case, a substantially stronger pallet which is far easier to assemble is provided, as more specifically set forth below. However, a preferred embodiment includes spiral finger elements since such type finger elements provide pallet legs which are much stronger and more resistant to sideways forces parallel to the pallet deck 14 applied to them.

The pallet deck 14, as indicated above, may be formed of multiple pallet deck members and these pallet deck members may be corrugated cardboard which is single wall, double wall, triwall or any combination thereof. However, a pallet deck 14 formed of at least two double wall corrugated cardboard pallet deck members 16 and 18, as illustrated, has been found to be satisfactory in most applications and is preferred except in those applications where the pallet 10 may be subjected to unusual rough treatment. Furthermore, the multiple pallet deck members preferably are stacked atop one another with the corrugations 46 thereof cross laminated, as illustrated in FIG. 2.

In assembling the pallet 10, the outer leg elements 20 are placed beneath the two stacked pallet deck members 16 and 18, and aligned with the respective circular score lines 34. Prior to stacking the pallet deck members 16 and 18, adhesive is applied over the finger elements 24 and the area immediately surrounding them on and preferably at least about the mating surfaces of the pallet deck members 16 and 18 adjacent the peripherial edges thereof. The inner leg elements 22 are aligned with the circular score lines 34 on top of the stacked pallet deck members 16 and 18, and then forcibly urged downwardly into the outer leg elements 20 while at the same time forcing the finger elements 24 of the respective ones of the pallet deck members 16 and 18 into the annulus 28 between the two nested outer and inner leg elements. The pallet legs 12 when attached to the pallet 10 effectively function like rivets to secure the two pallet deck members 16 and 18 together, hence the need to apply adhesive to the mating surfaces thereof and to clamp them together until the adhesive sets is eliminated. As indicated above, it is preferred to apply adhesive to the pallet deck members adjacent the peripheral edges thereof, but the pallet deck members 16 and 18 are fixedly secured to one another whether such adhesive is used or not. This feature of the improved pallet 10 provides substantial savings in both material costs and labor in handling, as well as the time involved in waiting for the adhesive to set, whether the pallet deck members 16 and 18 are single wall, double wall or other type of corrugated cardboard. Even when single wall pallet members 16 and 18 are used, a pallet 10 which is substantially stronger both with respect to deck strength and pallet leg strength is provided. A conventional pallet having a single wall corrugated cardboard deck member, with another single wall corrugated cardboard deck member adhesively affixed atop of it is not as strong as the pallet 10 of the present invention, since the pallet legs are attached to only the one single wall pallet deck member. As indicated above, the preferred construction of the pallet 10 has at least double wall corrugated cardboard pallet deck members 16 and 18, since they provide a pallet 10 which has far greater deck strength and leg strength. Also, while such pallets 10 whether formed of single wall or double wall corrugated cardboard pallet deck members display greater strength if straight finger elements are used, again it is preferred to use spiral finger elements because of the greater strength of the pallet legs against sideways forces parallel to the pallet deck applied to them.

Figure 7:
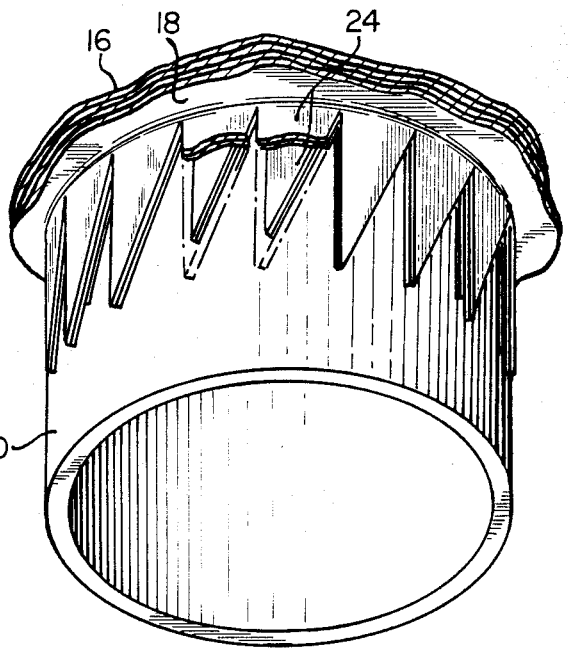
FIG. 7 is a view like FIG. 6 illustrating the manner in which the spiral fingers overlap in accordance with a preferred embodiment.

In stacking the pallet deck members 16 and 18 atop one another, it is preferred that they are stacked such that the circular score lines 30 defining the periphery of the finger elements both project toward the bottom of the pallet 10. It has been found that this arrangement provides greater leg strength. Also, as indicated above, it is preferred that the corrugations of the pallet deck members be cross-laminated when assembled. In this respect, when using spiral fingers, it is preferred to run one pallet deck member through the die-cutting machine with the corrugations running longitudinally of the machine, and to then run the other pallet deck member with its corrugations running perpendicular to the longitudinal axis of the machine so as to effectively die-cut a top and a bottom pallet deck member. As a practical matter, however, it makes no difference which pallet deck member is the top or the bottom one. The pallet deck members 16 and 18 preferably are die-cut in this fashion and then stacked atop one another with the circular score lines 30 facing downwardly. With this arrangement, when the pallet legs 12 are affixed to the pallet deck members 16 and 18, the finger elements 24 of the respective pallet deck members substantially completely overlie one another within the annulus 28 between the outer and inner leg elements 20, 22, as illustrated in FIG. 7. The finger elements are effectively adhesively secured to each other over substantially the entire surface area of the respective finger elements and to the walls of the outer and inner leg elements 20 and 22. It is found that this arrangement provides pallet legs which provide the greatest resistence to sideways forces applied to them.

Figure 8:
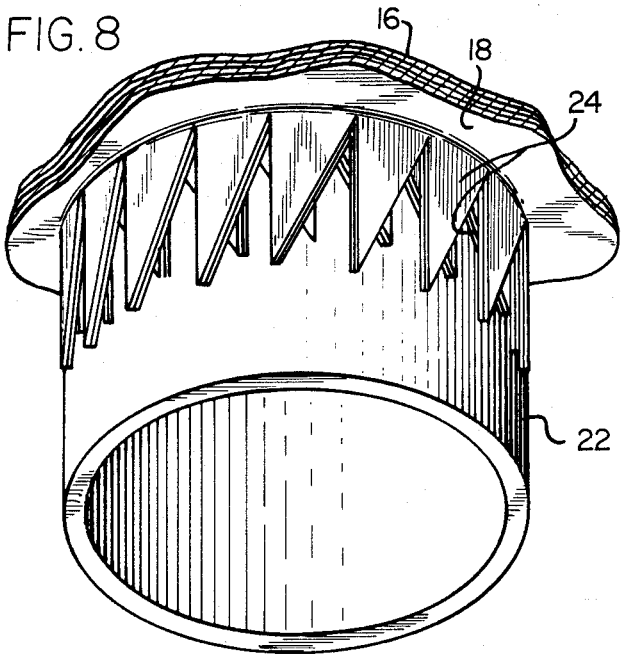
FIG. 8 is also a view like FIGS. 6 and 7 illustrating an alternative manner in which the spiral fingers can be overlapped.

The pallet deck members 16 and 18 can be die-cut as described above and then one flipped over atop the other prior to affixing the pallet leg 12 to them. When assembled in this fashion, the finger elements when urged into the annulus between the outer and inner leg elements 20 and 22 will radially overlap, as illustrated in FIG. 8. This arrangement provides a satisfactory pallet 10 having improved leg strength, but the leg strength of the pallets 10 having finger elements which overlap as illustrated in FIG. 7 is greater yet and thus preferred.

The straight finger elements, of course, so long as the pallet deck members 16 and 18 are die cut with the same dies always overlap as illustrated in FIG. 6.

Figure 9:
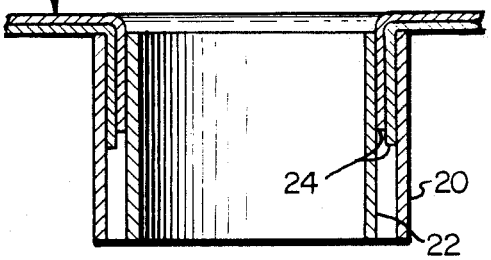
FIGS. 9 and 10 are partial side sectional views illustrating the longer spiral finger elements and the shorter straight finger elements, respectively.
Figure 10:
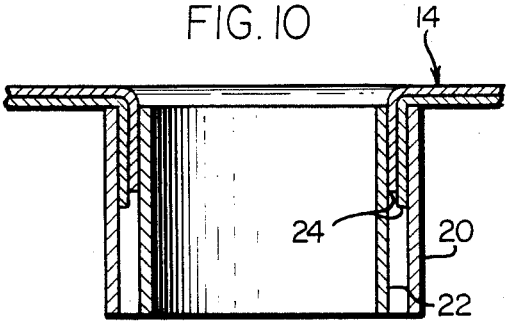

While the straight finger elements provide a satisfactory pallet 10, it is preferred to use spiral finger elements for at least several reasons. As indicated above, independent tests have shown that pallet legs when attached to the pallet deck with spiral fingers are much stronger and resistant to damage from sideways forces applied to them then the straight finger elements. Furthermore, as generally illustrated in FIGS. 9 and 10, the spiral finger elements are longer and project further into the annulus between the outer and inner leg elements than the straight finger elements. Accordingly, when multiple pallet deck members are used, more of the finger elements are available to be retained within the annulus between the outer and inner leg elements when the finger elements are folded over atop one another and forced into the annulus. Therefore, there is more surface area of the finger elements to adhesively secured together and to the walls of the leg elements.

Figure 11:
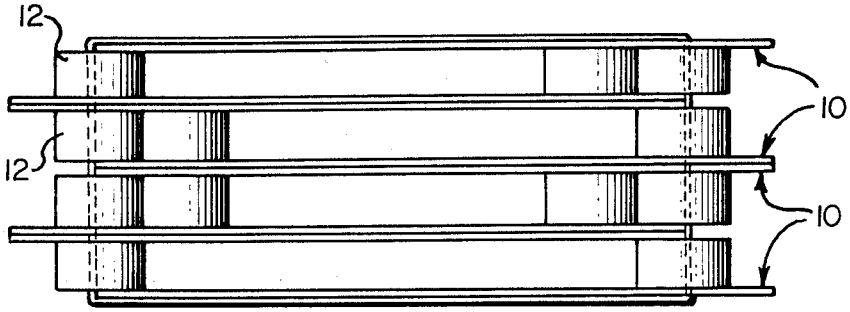
FIG. 11 is a side plan view illustrating how the pallets can be stacked for storage an shipping.

As indicated above, the pallets 10 are stacked one atop the other for storage and shipment, generally in the manner illustrated in FIG. 11. In this case, however, since the pallet decks 14 are much stronger the corner protectors normally used with the standard pallets can be eliminated. Accordingly, a substantial savings in material can be realized. Furthermore, the stacked pallets normally are band-wrapped to secure them in stacked relationship one atop the other. With the pallets 10 of the present invention, this is easily accomplished by extending the bands through the holes in the pallet legs 12, as illustrated, making banding thereof much easier. The pallets 10 then can be shrink-wrapped, if desired.

A pallet 50 having exceptional beam strength for supporting and transporting heavy loads is illustrated in FIGS. 12 & 13. As can be seen, the pallet 50 has a top pallet deck 52 and a bottom pallet deck 54, both of which are affixed to a number to pallet legs 56 in the same fashion as the pallet deck 14 of the pallet 10 is affixed to the pallet legs 12 thereof. More specifically, the pallet deck members 58 and 60 forming the pallet deck 54 are die cut to form finger elements, and the latter are forcibly urged into the annulus between the nested outer and inner leg elements forming a pallet leg 56. In this case, a second inner leg element is required and is nested in the same outer leg element used in attaching the top pallet deck 52 to a pallet leg 56. The second pallet deck 54 adds substantial rigidity to the pallet 50 and greatly increases its beam strength so that it is less likely to bend or flex in its longitudinal plane.

In FIG. 14 there is illustrated still another pallet 70 which is similar to the pallet 50, but in this case instead of a full second pallet deck only strips 72 are die-cut with finger elements and affixed to the pallet legs 74, as illustrated. Another pallet 80 is illustrated in FIG. 15 having the one length of the pallet deck 82 extended and folded generally U-shaped around the opposed sides of the pallet and affixed to the pallet legs 84. The beam strength of both of the pallet 70 and 80 is increased, but not to the extent that it is increased when a full pallet deck is used, as illustrated in FIGS. 12 and 13. Also, with the pallet 80, entry for forklift trucks is only provided or possible from two sides of the pallet.

Accordingly, from the above description it can be seen that a parallel 10 which can be easily manufactured and assembled, and particularly one which is light weight and inexpensive, is provided by the present invention. More particularly still, the pallet 10 has far greater deck strength and pallet legs which are much stronger and more resistant to damage from sideways forces parallel to the pallet deck applied to them than those known in the prior art or disclosed in the above identified copending application. The pallets 10 also can be easily stacked for shipment and storage.

What is claimed is:

1. A pallet comprising a pallet deck having a plurality of tubular legs attached thereto, each of said tubular legs being comprised of an inner and an outer leg element;

said pallet deck being comprised of at least two pallet deck members of corrugated cardboard stacked together atop one another, each of said pallet deck members at each leg attachment point having a plurality of finger elements formed of die-cut lines radiating outwardly from a central circle and terminating on a circular score line of substantially the same diameter as the inner diameter of an outer leg element, said finger elements being die-cut in the respective ones of said pallet deck members with the corrugations thereof extending perpendicular to one another, said pallet deck members being stacked atop one another with the corrugations thereof cross-laminated;

said inner and outer leg elements being proportioned to nest within one another and to retain said finger elements die-cut in both pallet deck members at a leg attachment point in overlapped relationship within the annulus formed between said nested outer and inner leg elements;

said tubular legs being secured to said pallet deck and said pallet deck members being secured together atop one another by placing an outer leg element under said stacked pallet deck members and aligned with said circular score line, an inner leg element atop said stacked deck members and aligned with said circular score line and then pressing said inner leg element through said stacked pallet deck members into said outer leg element with said finger elements being captured in overlapping relationship between said outer and inner leg elements;

and adhesively secured to one another and to said outer and inner leg elements.

2. The pallet of claim 1, wherein said die-cut lines forming said finger elements radiate tangentially outwardly from the periphery of the central circle to meet the circular score line, thereby forming spiral finger elements.

3. The pallet of claim 2, wherein said pallet deck members are stacked atop one another with the corrugations thereof cross-laminated and with the circular score lines on both apllet deck members facing downwardly toward the bottom of said pallet when assembled, said finger elements of the respective ones of said pallet deck members when said pallet is assembled substantially overlying one another within the annulus between said inner and outer leg elements.

4. The pallet of claim 2, wherein one of said pallet deck members if inverted and stacked atop the other one of said pallet deck members, said finger elements of the respective ones of said pallet deck members when said pallet is assembled radially overlying one another within the annulus between said inner and outer leg elements.

5. The pallet of claim 1, further comprising a second pallet deck secured to said pallet legs on the underside of said pallet, the manner of securement being the same as said pallet deck is secured to said pallet legs.

6. A method of manufacturing a pallet comprising the steps of:

forming a pallet deck of at least two corrugating cardboard pallet deck members stacked together atop one another, diecutting in each of said pallet deck members at each leg attachment point a plurality of finger elements formed of die-cut lines radiating outwardly from a central circle and terminating on a circular score line, said finger elements being die-cut in the respective ones of said pallet deck members with the corrugations thereof extending perpendicular to one another, said pallet deck members being stacked atop one another with the corrugations thereof cross-laminated;

providing a plurality of pallet legs, each of which is comprised of inner and outer leg elements being proportioned to nest within one another and to retain said finger elements die-cut in both pallet deck members at a leg attachment point in overlapped relationship within the annulus formed between said nested outer and inner leg elements;

securing said pallet deck members together and and said pallet legs to said pallet by placing an outer leg element under said stacked pallet deck members and aligned with said circular score line, an inner leg element atop said stacked deck members and aligned with said circular score line, and forcibly inserting said inner leg element into said outer leg element with said finger elements being captured between said outer and inner leg elements by pressing said inner leg element through said stacked pallet deck members into said outer leg element, said finger elements being overlapped and adhesively secured to one another and to said outer and inner leg elements.

7. The method of claim 6, wherein said die-cut lines forming said finger elements radiate tangentially outwardly from the periphery of the central circle to meet the circular score line, thereby forming spiral finger elements.

8. The method of claim 7, wherein said pallet deck members are stacked atop one another with the corrugations thereof cross-laminated and with the circular score lines on both pallet deck members facing downwardly toward the bottom of said pallet when assembled, said finger elements of the respective ones of said pallet deck members when said pallet is assembled substantially overlying one another within the annulus between said inner and outer leg elements.

9. The method of claim 7, wherein one of said pallet deck members is inverted and stacked atop the other one of said pallet deck members, said finger elements of the respective ones of said pallet deck members when said pallet is assembled radially overlying one another within the annulus between said inner and outer leg elements.

10. The method of claim 6, further comprising the step of securing a second pallet deck to said pallet legs on the underside of said pallet in the same manner in which said pallet deck is secured to said pallet legs.

* * * * *

UNITED STATES PATENT AND TRADEMARK OFFICE

CERTIFICATE OF CORRECTION

PATENT NO. : 4,850,284

DATED : July 25, 1989

INVENTOR(S) : Robert H. DeGroot et al.

It is certified that error appears in the above-identified patent and that said Letters Patent is hereby corrected as shown below:

Please correct the spelling of inventor Frank Walaszek's name on the title page as follows: Delete "Wakaszek" and substitute "Walaszek".

Signed and Sealed this

Fifteenth Day of May, 1990

*Attest:*

HARRY F. MANBECK, JR.

*Attesting Officer*

*Commissioner of Patents and Trademarks*